US007055424B1

(12) United States Patent
Bielli

(10) Patent No.: US 7,055,424 B1
(45) Date of Patent: Jun. 6, 2006

(54) TWO-STATION PRESS FOR TEXTILE MATERIAL

(76) Inventor: Tiziano Bielli, Via Buozzi 47, 59100 Prato (IT)

( * ) Notice: Subject to any disclaimer, the term of this patent is extended or adjusted under 35 U.S.C. 154(b) by 0 days.

(21) Appl. No.: 09/959,056

(22) PCT Filed: Apr. 15, 1999

(86) PCT No.: PCT/IT99/00091

§ 371 (c)(1),
(2), (4) Date: Oct. 15, 2001

(87) PCT Pub. No.: WO00/38908

PCT Pub. Date: Jul. 6, 2000

(51) Int. Cl.
*B65B 13/02* (2006.01)

(52) U.S. Cl. ..... 100/18; 100/138; 100/244; 100/95

(58) Field of Classification Search ..... 100/3, 100/5, 7, 8, 14, 95, 177, 178, 179, 245, 185, 100/138, 17, 18, 244, 265
See application file for complete search history.

(56) References Cited

U.S. PATENT DOCUMENTS 3,451,185 A * 6/1969 Tezuka ..... 53/397
3,613,556 A * 10/1971 Wright et al. ..... 100/14
5,687,643 A * 11/1997 Felts et al. ..... 100/3

FOREIGN PATENT DOCUMENTS

| | | |
|---|---|---|
| EP | 0150687 | 8/1985 |
| EP | 0198992 | 10/1986 |
| FR | 2389537 | 12/1978 |
| IT | 1201240 | 2/1985 |
| IT | 1201292 | 5/1985 |
| IT | 1214914 | 8/1985 |
| IT | 207273 | 5/1986 |
| WO | WO 9604170 | 2/1996 |

* cited by examiner

*Primary Examiner*—Allen Ostrager
*Assistant Examiner*—Shelly Self
(74) *Attorney, Agent, or Firm*—McGlew & Tuttle, PC

(57) ABSTRACT

The press for forming bales of textile material comprises a first pre-pressing station (3) and a second pressing station (5), with transfer means for transferring the pre-pressed material from the first station to the second station. The transfer means comprise two containment walls, an upper and a lower (33, 35), approximately parallel with each other and defining a transfer path between said first and said second stations, and a ram (25) that pushes the pre-pressed material from the first station to the second station by sliding it between said two containment walls.

16 Claims, 11 Drawing Sheets

TWO-STATION PRESS FOR TEXTILE MATERIAL

TECHNICAL FIELD

The present invention relates to a press, for forming bales of textile material, of the type comprising a first pre-pressing station and a second pressing station, with transfer means for transferring the pre-pressed material from the first station to the second station.

STATE OF THE ART

Two-station presses, that is to say presses having a pre-pressing station and a final pressing and binding station, are known for example from Italian patents No. 1,201,292, No. 1,201,240, No. 1,214,914 and from Italian Registered Utility Model No. 207,273. These presses employ a carriage, which in certain cases also defines the pre-pressing volume, which transfers the material partly pressed in the pre-pressing station to the final pressing and binding station. This approach, although efficient, has relatively high costs, particularly when the press has to be designed to suit particular user requirements.

OBJECTS AND SUMMARY OF THE INVENTION

It is an object of the present invention to provide a press of the abovementioned type that overcomes the disadvantages of known presses and in particular is more economical, simpler to design and build and more easily and economically adaptable to the needs of individual users, who may require variable configurations of the press depending on the layout of their own installations, the type of work that they carry out and the number of machines required.

These and other objects and advantages, which will become clear to those skilled in the art upon reading the text that follows, are achieved with a press of the type referred to at the beginning, in which the transfer means for transferring the pre-pressed material from the first pre-pressing station to the second final pressing station comprise two containment walls, an upper and a lower, approximately parallel with each other and defining a transfer path between the first and the second stations, and a ram that pushes the pre-pressed material from the first station to the second station for example by sliding it between the two containment walls along the transfer path from the first station to the second.

Other advantageous features of the press according to the invention are indicated in the accompanying dependent claims. In particular the pre-pressing volume of the first station may be bounded on two vertical sides by a movable vertical wall and by a plate or platen acting as the ram of the material. The movable wall may be hinged about a vertical axis, movable along horizontal tracks or otherwise constructed, so long as it can be retracted from the path of transfer of the material during the first and second stations. Whereas the pre-pressing volume is preferably bounded also on the remaining two vertical sides, the path of transfer of the partly pressed material from the first station to the second station may be bounded only above and below by the abovementioned containment walls, and be laterally open for some or all of its length. Among other things, this allows the insertion of binding strap guide channels of the binding machine which is normally situated in the second final pressing station.

Above the pre-pressing volume of the first station there may be, as is known per se, a zone into which the textile material coming from a so-called condenser is loaded. The loading zone is situated vertically above the pre-pressing volume and is separable from it by means of, for example, a system of combs that allows a pre-pressing surface to push the material out of the loading zone into the pre-pressing volume several times while keeping the pre-pressed material inside the pre-pressing volume.

In order that idle time can be reduced and production increased accordingly, in one particularly advantageous embodiment of the press according to the invention, said ram that transfers the material from the first station to the second is linked to a movable horizontal panel that is interposed between the loading zone and the pre-pressing volume during the transfer of the pre-pressed material from the first station to the second. Consequently while the ram is pushing the pre-pressed material along the transfer path, it is possible to begin feeding the textile material from the condenser into the loading zone above the pre-pressing volume for the next pressing cycle. This material is temporarily held above the movable horizontal panel which is then retracted, when the ram is returned to the rest position.

BRIEF DESCRIPTION OF THE DRAWINGS

A clearer understanding of the invention will be gained by following the description and the attached drawing, which latter shows a practical, non-restrictive example of the invention. In the drawing.

DETAILED DESCRIPTION OF THE PREFERRED EMBODIMENTS

Figure 1:
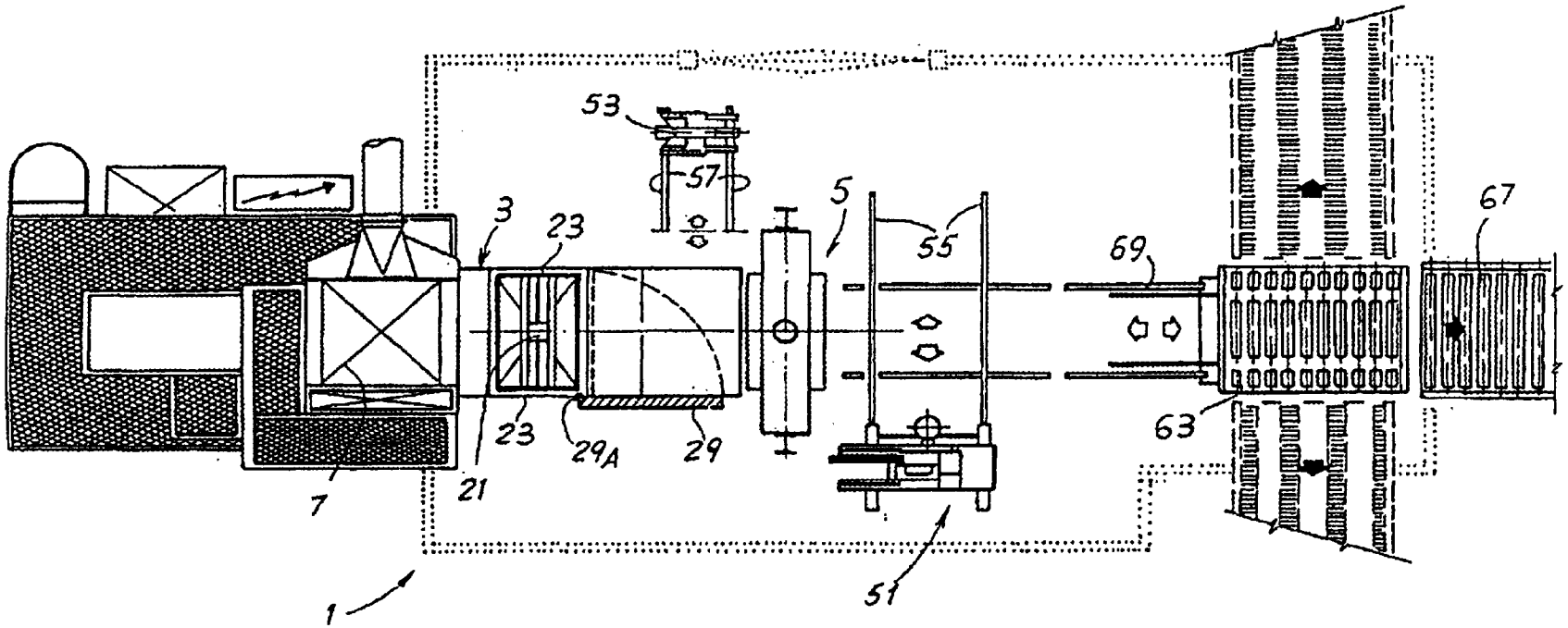
FIG. 1 shows a plan view of a press according to the invention.

Referring initially to FIGS. 1–6, the press, which has the general reference 1, comprises a first pre-pressing station 3 and a second pressing and binding station 5. Connected to the pre-pressing station 3 is a so-called condenser 7 which feeds in the textile material to be packaged in bales. The condenser 7 feeds the textile material into a loader 9, from which a cylinder-and-piston system 11 with a plate 13 having reciprocating movement indicated by the double arrow f13 discharges the textile material into a loading zone 15 situated above a pre-pressing volume 17. The loading zone 15 and the pre-pressing volume 17 have an associated pre-pressing plate 19 actuated by a cylinder-and-piston actuator of e.g. hydraulic type 21. As can be seen in the plan view of FIG. 1 the pre-pressing volume and the loading zone 15 situated above the latter are basically rectangular in plan view, although this is not essential, as the shape of the pre-pressing volume may be different, e.g. cylindrical.

The pre-pressing volume 17 is bounded by two fixed vertical walls 23 (FIG. 1) approximately parallel to the plane of FIG. 2, as well as by a platen 25 forming part of a ram 27 having the function specified later, and by a vertical wall 29 parallel to the platen 25 and capable of moving, specifically of pivoting about a vertical axis 29A (see FIG. 1).

Between the pre-pressing station 3 and the final pressing station 5 runs a horizontal transfer path 31 bounded above by a first containment wall 33 and below by a second containment wall 35 parallel to the wall 33. Laterally, i.e. parallel to the plane of FIG. 2, the transfer path 31 is, in the example illustrated, open. The pivoting movement of the movable wall 29 enables the pre-pressing space 17 to be placed in communication, when the wall 29 is in the position shown in FIG. 1, with the transfer path 31 leading to the final pressing station 5. The latter comprises a first upper pressing plate 37 actuated by a cylinder-and-piston actuator 39, and a second lower pressing plate 41 that can be moved vertically by a cylinder-and-piston actuator 43 housed in a space prepared below the plane of the floor.

The platen 25 of the ram 27 is movable in the directions of the double arrow f27, and this movement is controlled by a horizontally extending cylinder-and-piston actuator 45 located in an extension of the transfer path 31 to the left (in FIG. 2) of the pre-pressing space 17. Connected to the platen 25 is a horizontal panel 47 that traverses in the directions of the double arrow f27 together with the platen 25 under the actuation of the actuator 45 for the purposes indicated later.

Above the pre-pressing space 17 and the upper containment wall 33 are two comb systems 49 that can traverse horizontally, or pivot about horizontal axes in order to hold the pre-pressed material in the pre-pressing space 17 when the pre-pressing plate 19 is raised, thus preventing the pre-pressed textile material from re-expanding in the loading zone 15.

At the pressing and binding station 5 is a binding machine 51, of a type known per se, having a series of guide channels, marked 53, for the binding straps. A single binding machine 51, 53 can serve more than one press and for this purpose it is movable on horizontal tracks 55 (see FIG. 1), while the channels 53 are movable along corresponding horizontal tracks 57.

Also at the pressing and binding station is a carriage 61 with a collecting device 63 that collects and removes the pressed and bound bales from the final pressing station 5.

The operation of the press described thus far will now be explained with reference to FIGS. 2–6 which show successive steps in the operation. In FIG. 2 the textile material is pre-pressed in the pre-pressing space 17, while the pressing station 5 is inactive and awaits the arrival of the pre-pressed material. Pre-pressing is carried out by loading one or more deliveries of loose material into the loading volume 15 and then pushing this material by means of the pre-pressing plate 19 into the pre-pressing volume 17, which is bounded by the two walls parallel to the plane of FIG. 2, by the platen 25 and by the vertical movable wall 29 opposite the platen 25. When the pre-pressing plate 19 rises, the pre-pressed material is held in place by the combs 49, the pre-pressing plate 19 being able as it rises to pass above the combs 49 as there are corresponding slots formed in it, as known in the prior art.

Figure 2:
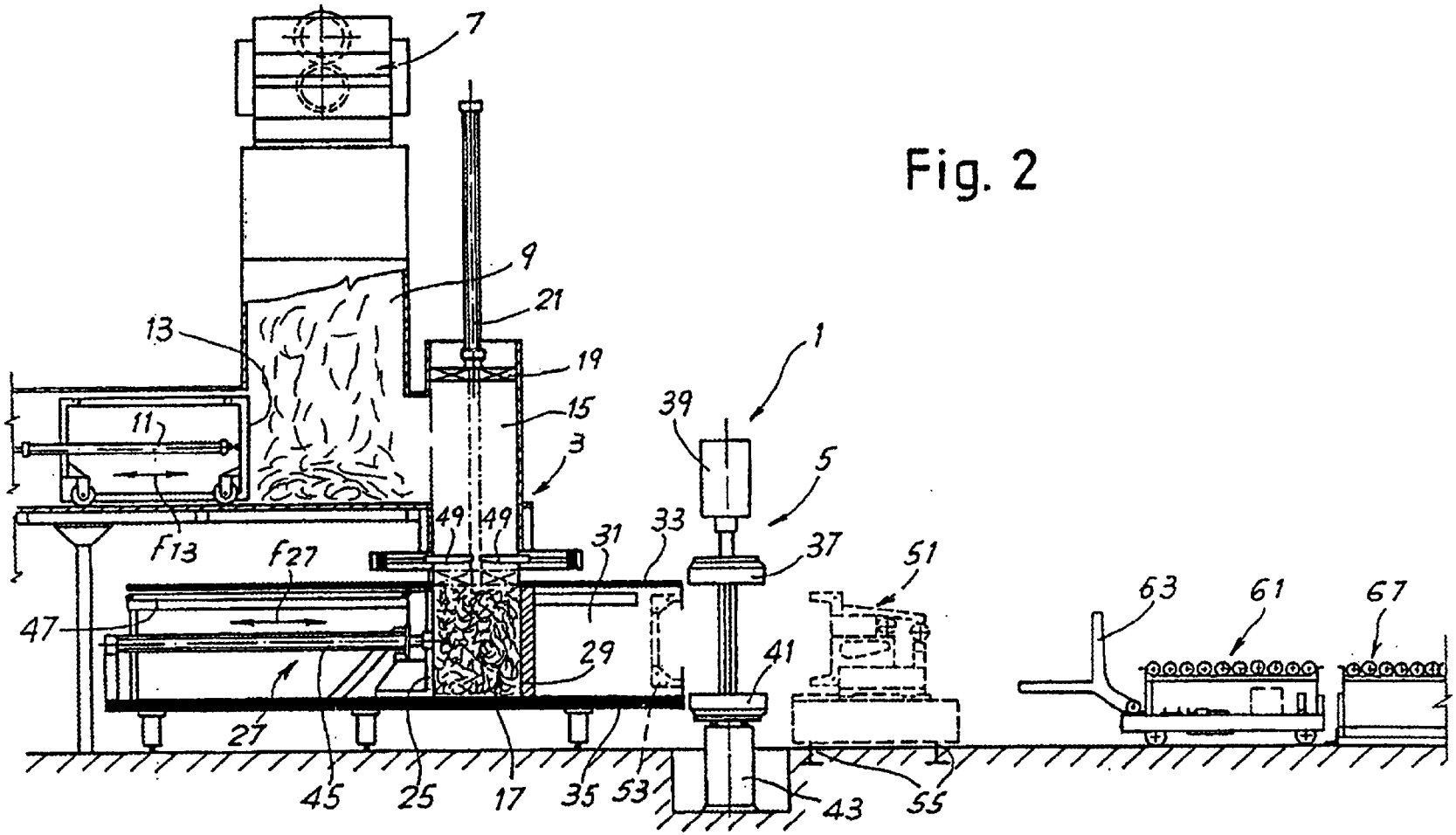
FIGS. 2–6 show in side view and partial section five successive steps in the operation of the press.

When the desired quantity of textile material has been accumulated and partially pressed in the pre-pressing space, the pre-pressing plate 19 returns to the raised position of FIG. 2 and the ram 27 transfers the pre-pressed material to the final pressing station 5. For this purpose the cylinder-and-piston actuator 45 pushes the platen 25 toward the final pressing station 5, moving said platen 25 from the position of FIG. 2 to that of FIG. 3. In this movement the horizontal panel 47 follows the platen 25 of the ram 27 and closes off the bottom end of the loading space 15, where the device 11, 13 can recommence loading the material for the next pre-pressing action. The material introduced into the loading space 15 is temporarily held in place by the movable panel 47. The pre-pressed textile material M (FIG. 3) slides along, pushed by the ram 27, or more precisely by the latters platen 25, between the upper 31 and lower 35 containment walls.

Figure 3:
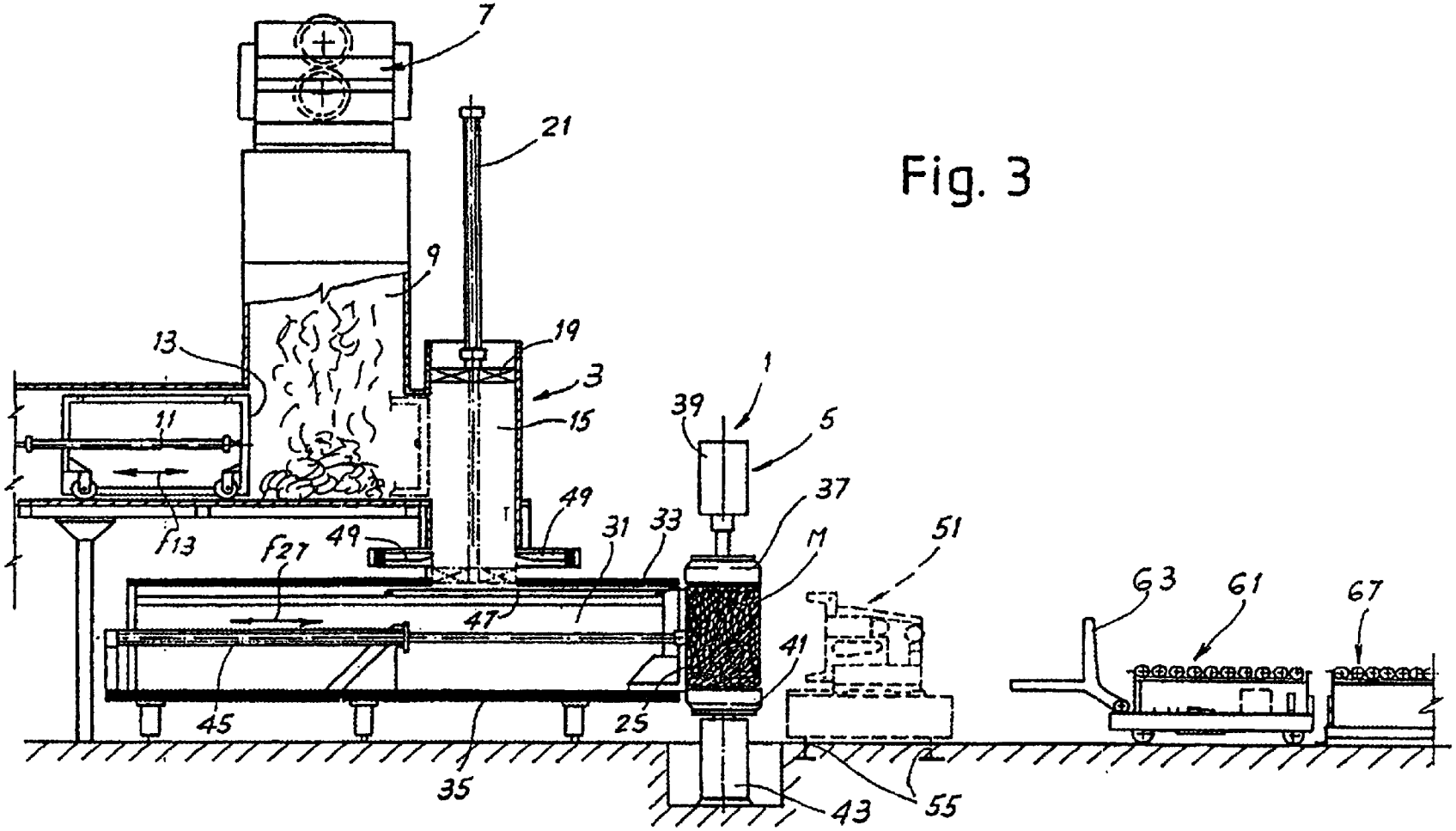
Figure 4:
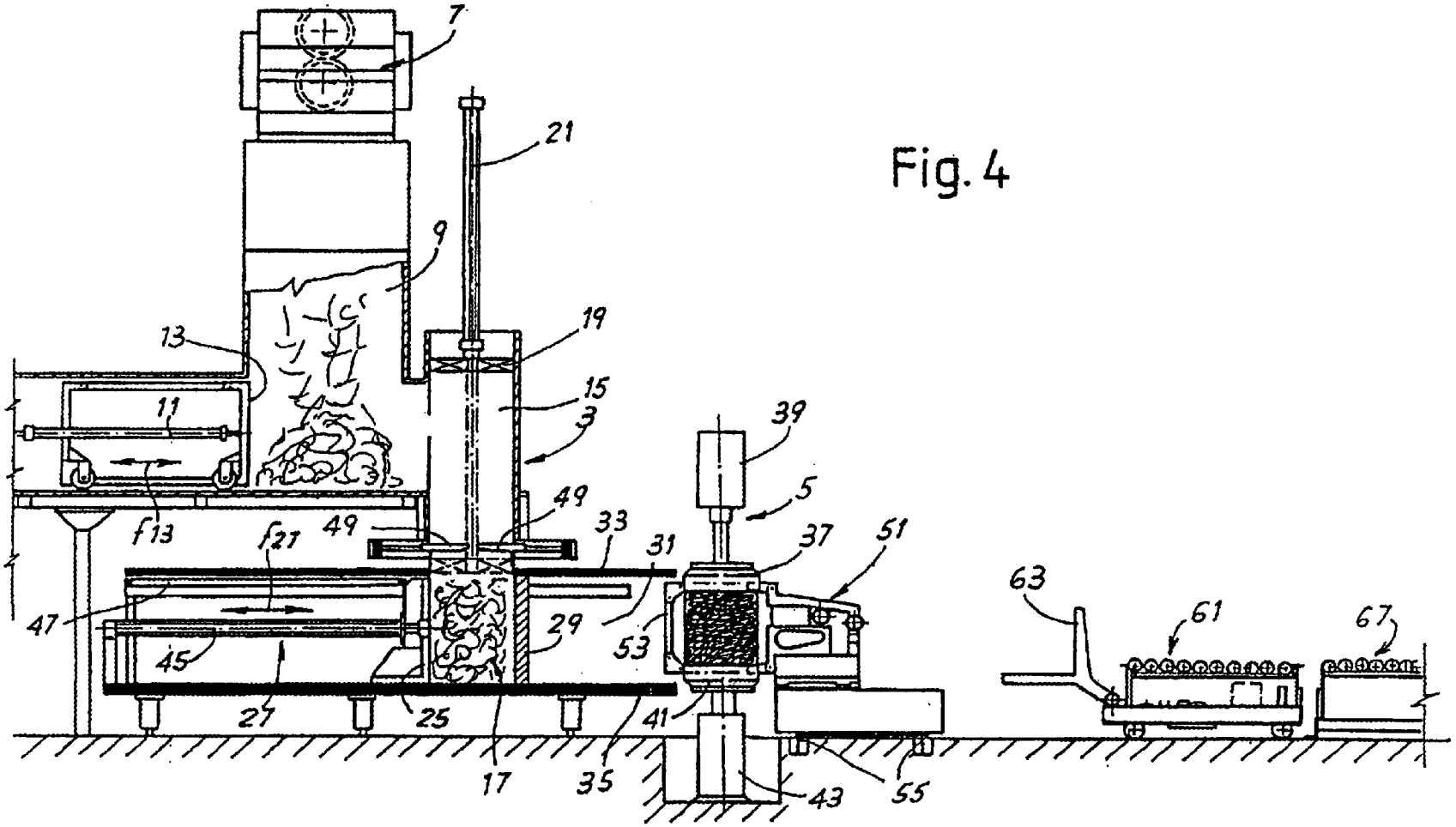

When the partially pressed material M has reached the position of FIG. 3, the ram 27 can withdraw to the initial position, as shown in FIG. 4, while the pressing plates 37 and 41 can be advanced toward each other to force the material M into its final volume (FIG. 4). Simultaneously, the panel 47 having moved back out of the loading zone 15 and out of the pre-pressing volume 17, a new step of pre-pressing the material can be started in the latter. Binding takes place in the final pressing station 5 with the binding machine 51 and guide channels 53 being moved into the operating position, illustrated in FIG. 4 by the fact that these two elements are here indicated in solid lines.

Figure 5:
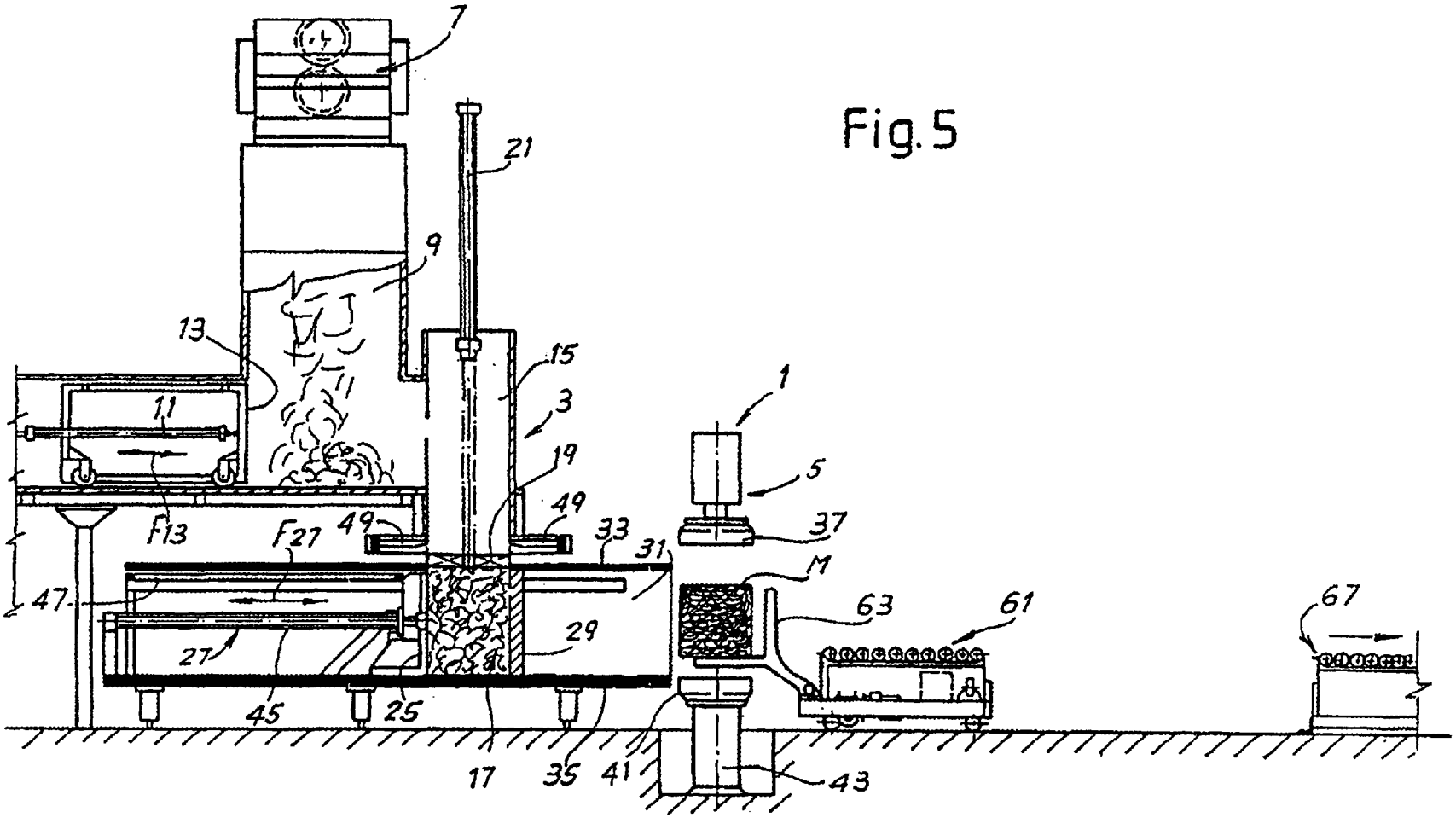
Figure 6:
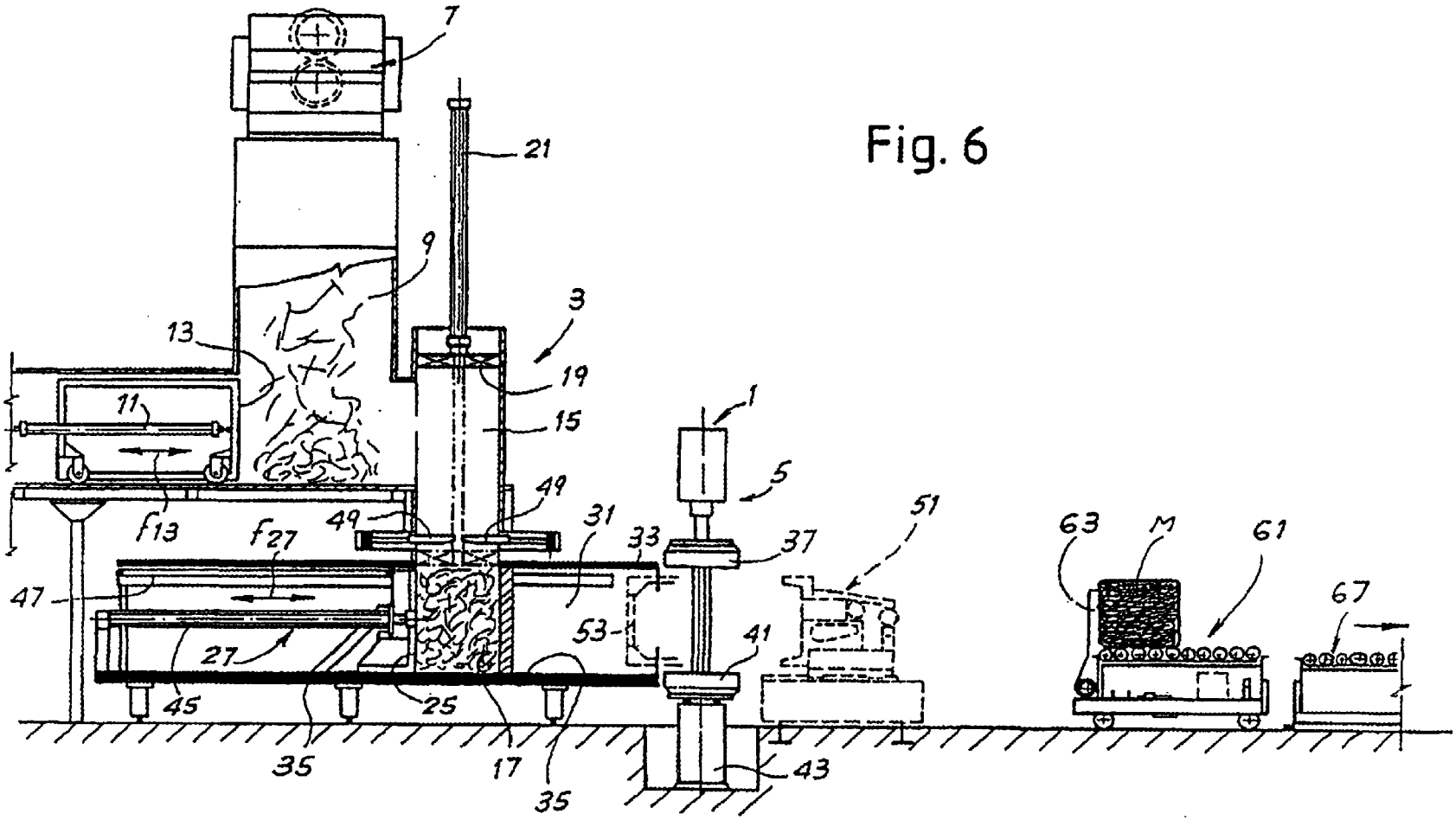

Once binding is completed, the bale of pressed material M is collected from the pressing station 5 as shown in FIG. 5, while pre-pressing of the material continues in the pre-pressing station 3. FIG. 6 shows the removal of the pressed and bound bale and completion of pre-pressing in the pre-pressing pressing station 3. Once this step is completed the cycle recommences with the platen 25 of the ram 27 moving toward the pressing station 5.

The pressed and bound bales of material M are transferred by the carriage 61 to roller conveyors 67 or other suitable handling means. The movement in which the carriage 67 approaches the second pressing station 5 is not obstructed by the binding machine 51, which for this purpose is moved away from the tracks 69 (see in particular FIG. 1) along which the carriage 63 runs.

FIGS. 7–11 show five successive steps in the operation of a different embodiment of the press. Parts identical to or corresponding with those of FIGS. 1–6 are given the same reference numerals increased by 100.

The press, which has the general reference 101, comprises a first pre-pressing station 103 and a second pressing and binding station 105. Connected to the pre-pressing station 103 is a so-called condenser 107 which feeds in the textile material to be packaged in bales. The condenser 107 feeds the textile material into a loader 109, from which a cylinder-and-piston system 111 with a plate 113 having reciprocating movement indicated by the double arrow f113 discharges the textile material into a loading zone 115 situated above a pre-pressing volume 117. The loading zone 115 and the pre-pressing volume 117 have an associated pre-pressing plate 119 actuated by a cylinder-and-piston actuator of e.g. hydraulic type 121.

The pre-pressing volume 117 is bounded by two fixed vertical walls (not visible) equivalent to the walls 23 and approximately parallel to the plane of FIGS. 7–11, as well as by a platen 125 forming part of a ram 127 and by a vertical wall 129 parallel to the platen 125 and capable of moving, specifically of pivoting about a vertical axis 129A.

Figure 7:
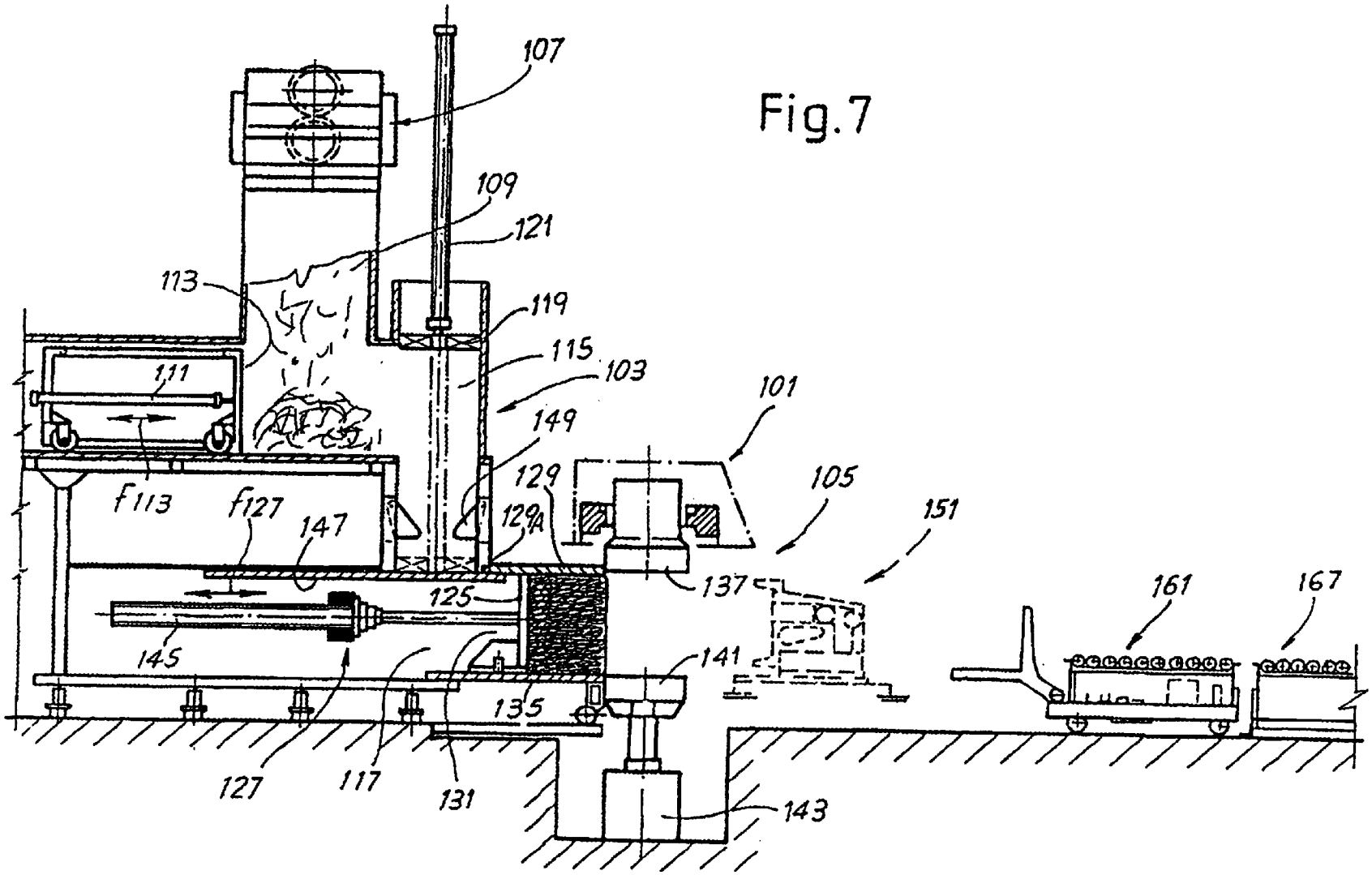
FIGS. 7–11 show five successive steps in the operation of an improved version of the press according to the invention.
Figure 8:
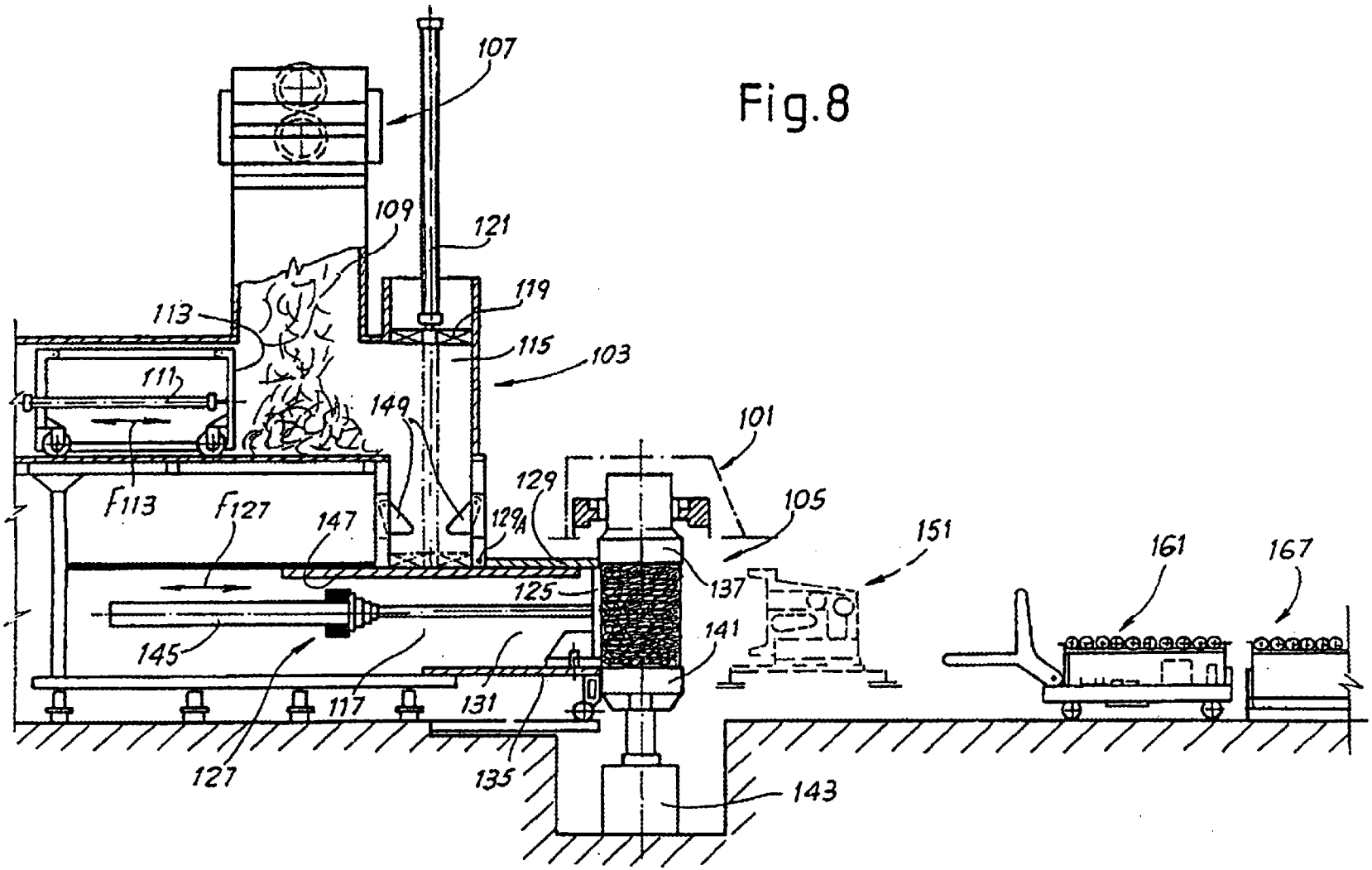
Figure 9:
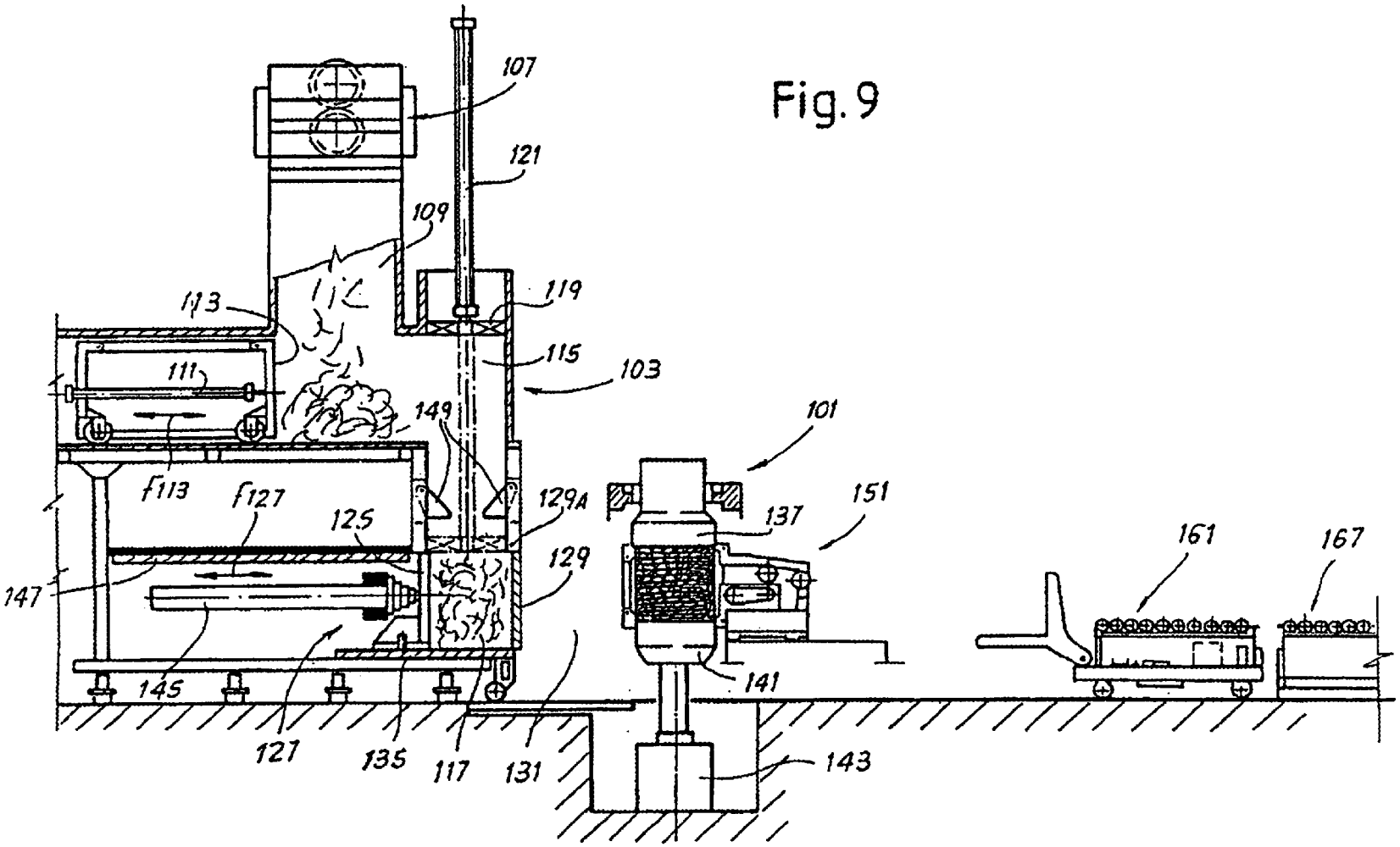
Figure 10:
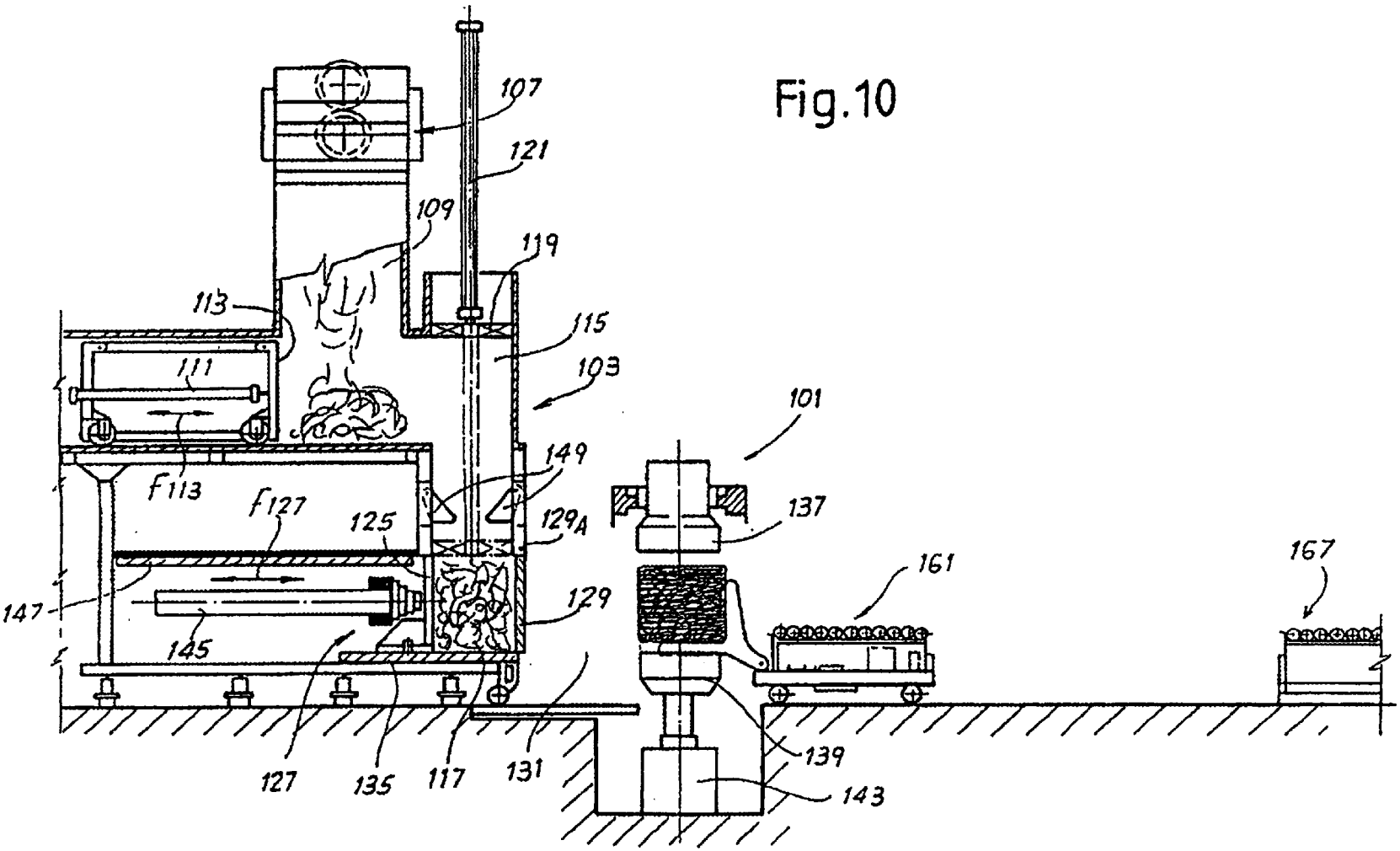
Figure 11:
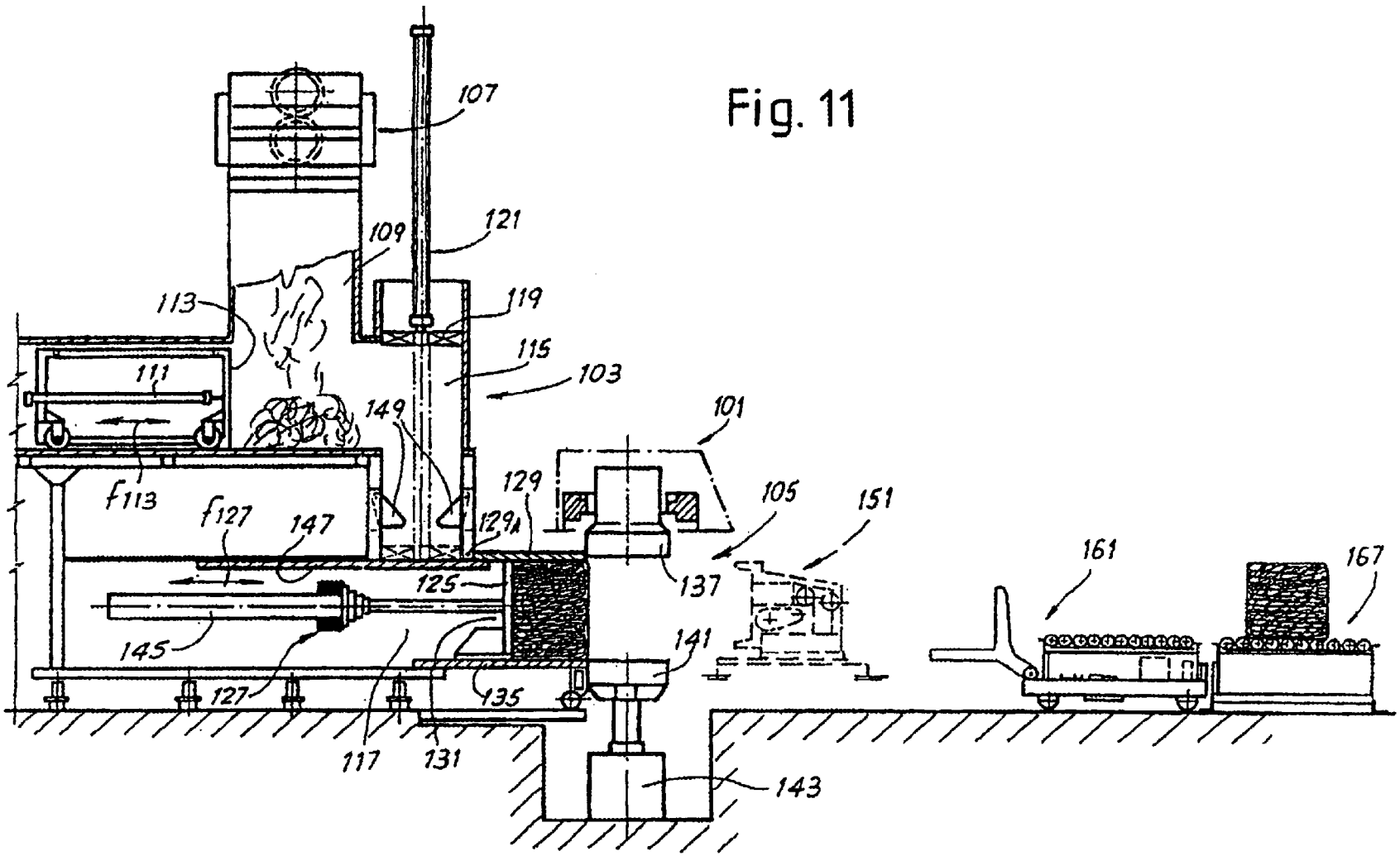

Between the pre-pressing station 103 and the final pressing station 105 runs a horizontal transfer path 131 bounded above by a first wall which is formed by the vertical wall 129 when the latter assumes the raised position, as visible in FIGS. 7, 8 and 11. A first substantial difference from the previous embodiment is therefore that a single pivoting component forms not only one of the walls of vertical closure of the pre-pressing zone, but also a first horizontal containment wall along the transfer path 131. This path is bounded on the underside by a second horizontal containment wall 135. This wall is movable horizontally in the same direction as the platen 125, as explained later.

Laterally, i.e. parallel to the plane of FIG. 7, the transfer path 131 is, in the example illustrated, open.

The pivoting movement of the movable wall 129 enables the pre-pressing space 117 to be placed in communication, when the wall 129 is in the position shown in FIG. 7, with the transfer path 131 leading to the final pressing station 105. The latter comprises a first fixed upper pressing plate 137 and a second lower pressing plate 141 that can be moved vertically by a cylinder-and-piston actuator 143 housed in a space prepared below the plane of floor. Obviously, this illustrative embodiment could again have two pressing plates 137, 141 that are both movable, or else an upper plate that can move down and a fixed lower plate.

The platen 125 of the ram 127 is movable in the directions of the double arrow f127, and this movement is controlled by a horizontally extending cylinder-and-piston actuator 145 located in an extension of the transfer path 131 to the left (in FIG. 7) of the pre-pressing space 117. Connected to the platen 125 is a horizontal panel 147 that traverses in the directions of the double arrow fl 27 together with the platen 125 (or at any rate in some manner coordinated with the latter) under the actuation of the actuator 145.

Above the pre-pressing space 117 and the upper containment wall 133 are two comb systems 149 that can pivot about horizontal axes in order to hold the pre-pressed material in the pre-pressing space 117 when the pre-pressing plate 119 is raised, thus preventing the pre-pressed textile material from re-expanding in the loading zone 115.

At the pressing and binding station 105 is a binding machine 151, similar to the binding machine 51, as well as a carriage 161 with a collecting device that collects and removes the pressed and bound bales from the final pressing station 105.

The operation of the press illustrated in FIGS. 7–11 is similar to the operation of the press of the previous FIGS. 1–6 and will not therefore be described again. However, in this second embodiment there is a significant difference concerning the structure of the path 131 along which the pre-pressed material is transferred to the final pressing station 105. Specifically, in the previous case the path was bounded above and below by fixed upper and lower horizontal containment walls 33 and 35, while the wall 29 acted as a retractable separator for separating the pre-pressing zone from the transfer path. In the second embodiment the wall 129 assumes the dual function of a wall separating the pre-pressing zone from the transfer path, and also, in alternation, of an upper containment wall during the transfer.

In addition to this, the lower horizontal containment wall 135 is no longer fixed but movable in coordination with the movement of the platen 125 of the ram 127, as visible in the sequence shown in FIGS. 7–11. During pre-pressing (FIG. 9), the wall 135 is level with the pre-pressing space 117. During the stroke of the ram 127 toward the final pressing station 105 the wall 135 traverses together with the ram as far as the position of FIG. 7, and therefore in this first phase of the transfer the pre-pressed material is not scraping along the lower wall. The final section of the transfer movement involves sliding the material against both containment walls 129 and 135 because the latter wall remains in a fixed position (see passage from FIG. 7 to FIG. 8).

The arrangement described immediately above makes it possible to have an unoccupied and accessible zone between the first pre-pressing station 103 and the second final pressing station 105 throughout the operational steps (or during the intervals of inactivity of the machine) except for the step in which the material is transferred from the first station to the second. This facilitates maintenance, inspection and any other operation necessary around the machine.

It will be understood that the drawing shows only an example purely as a practical demonstration of the invention, which invention can vary in its shapes and arrangements without thereby departing from the scope of the concept on which the invention is based.

What is claimed:

1. A press for forming bales of textile material, comprising a first pressing station; a second pressing station arranged spaced from said first pressing station; transfer means for transferring the pre-pressed material from the first pressing station to the second pressing station, wherein said transfer means includes an upper and a lower containment wall, approximately parallel with each other and defining a transfer path between said first pressing station and said second pressing station, and a ram that pushes the pre-pressed material from the first pressing station to the second pressing station between said two containment walls, said first pressing station including a loading zone arranged above a pre-pressing volume and a movable panel, said movable panel temporarily closing the bottom of said loading zone while the ram pushes the pre-pressed material from the first station to the second station wherein the first pressing station has a pre-pressing volume bounded on a first side by the ram and on a second side, opposite the first, by a movable vertical wall that is retracted while the pre-pressed material is being transferred from the first station to the second.

2. Press as claimed in claim 1, wherein the pre-pressing volume is further bounded by two fixed vertical walls.

3. Press as claimed in claim 1, further comprising a system of combs above the pre-pressing volume for retaining the pre-pressed material.

4. A press in accordance with claim 1, wherein:

said transfer path is longer than a length of the pre-pressed material;

said two containment walls are arranged between said first and second pressing stations.

5. A press for forming bales of textile material, comprising a first pressing station; a second pressing station arranged spaced from said first pressing station; transfer means for transferring the pre-pressed material from the first station to the second station, wherein said transfer means includes an upper and a lower containment wall, approximately parallel with each other and defining a transfer path between said first and said second stations, and a ram that pushes the pre-pressed material from the first station to the second station between said two containment walls, said first pressing station includes a loading zone arranged above a pre-pressing volume and a movable panel, said movable panel temporarily closing the bottom of said loading zone while the ram pushes the pre-pressed material from the first station to the second station, wherein said ram is linked to a movable horizontal panel that is interposed between a loading zone and the pre-pressing volume during the transfer of the pre-pressed material from the first pressing station to the second pressing station.

6. Press as claimed in claim 5, wherein said panel is fixed to the ram.

7. A press for forming bales of textile material, comprising a first pressing station; a second pressing station arranged spaced from said first pressing station; transfer means for transferring the pre-pressed material from the first station to the second station, wherein said transfer means includes an upper and a lower containment wall, approximately parallel with each other and defining a transfer path between said first and said second stations, and a ram that pushes the pre-pressed material from the first station to the second station between said two containment walls, said first pressing station includes a loading zone arranged above a pre-pressing volume and a movable panel, said movable panel temporarily closing the bottom of said loading zone while the ram pushes the pre-pressed material from the first station to the second station, wherein the path defined by the two containment walls is laterally open.

8. Press as claimed in claim 7, wherein at the second pressing station is a binding machine comprising a plurality of binding strap guide channels which are positioned in the transfer path during the binding of the pressed material.

9. A press for forming bales of textile material, comprising a first pressing station; a second pressing station arranged spaced from said first pressing station; transfer means for transferring the pre-pressed material from the first station to the second station, wherein said transfer means includes an upper and a lower containment wall, approximately parallel with each other and defining a transfer path between said first and said second stations, and a ram that pushes the pre-pressed material from the first station to the second station between said two containment walls, said first pressing station includes a loading zone arranged above a pre-pressing volume and a movable panel, said movable panel temporarily closing the bottom of said loading zone while the ram pushes the pre-pressed material from the first station to the second station, wherein said ram transfers the material from the first station to the second by sliding it between said two containment walls and said lower containment wall is movable in the direction of transfer of the material.

10. Press as claimed in claim 9, wherein the path defined by the two containment walls is laterally open.

11. Press as claimed in claim 9, wherein at the second pressing station is a binding machine comprising a plurality of binding strap guide channels which are positioned in the transfer path during the binding of the pressed material.

12. A press for forming bales of textile material, comprising a first pressing station and a second pressing station, with transfer means for transferring the pre-pressed material from the first station to the second station, wherein said transfer means include an upper and a lower containment wall, approximately parallel with each other and defining a transfer path between said first and said second stations, and a ram that pushes the pre-pressed material from the first station to the second station between said two containment walls, said first pressing station including a loading zone arranged above a pre-pressing volume and a movable panel, said movable panel temporarily closing the bottom of said loading zone while the ram pushes the pre-pressed material from the first station to the second station, the first pressing station having a pre-pressing volume bounded on a first side by the ram and on a second side, opposite the first, by a movable vertical wall that is retracted while the pre-pressed material is being transferred from the first station to the second station, said movable vertical wall acts as said upper containment wall, being moved into the horizontal position while the material is being transferred from the first station to the second.

13. Press as claimed in claim 12, wherein said movable vertical wall is hinged about a horizontal axis perpendicular to the direction of transfer of the material between the first and second stations.

14. A press for forming bales of textile material, comprising a first pressing station and a second pressing station, with transfer means for transferring the pre-pressed material from the first station to the second station, wherein said transfer means include an upper and a lower containment wall, approximately parallel with each other and defining a transfer path between said first and said second stations, and a ram that pushes the pre-pressed material from the first station to the second station between said two containment walls, said first pressing station including a loading zone arranged above a pre-pressing volume and a movable panel, said movable panel temporarily closing the bottom of said loading zone while the ram pushes the pre-pressed material from the first station to the second station, said lower containment wall being movable in the direction of transfer of the material.

15. Press as claimed in claim 14, wherein said lower containment wall is capable of a translational movement coordinated with the translational movement of said ram.

16. Press as claimed in claim 14, wherein the movement of said ram includes a further stroke beyond the movement of said lower containment wall.

* * * * *